US008739993B2

(12) United States Patent
Dunn et al.

(10) Patent No.: US 8,739,993 B2
(45) Date of Patent: Jun. 3, 2014

(54) CONTAINER FOR SPILLPROOF CONTAINER ASSEMBLIES

(75) Inventors: Steven B. Dunn, Beverly Hills, CA (US); Mark A. Hatherill, Beverly Hills, CA (US); Rodolfo Gastelum, San Pedro, CA (US); Won Song, Porter Ranch, CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 13/192,438

(22) Filed: Jul. 27, 2011

(65) Prior Publication Data

US 2012/0305577 A1 Dec. 6, 2012

Related U.S. Application Data

(60) Provisional application No. 61/493,132, filed on Jun. 3, 2011.

(51) Int. Cl.
*B65D 1/40* (2006.01)

(52) U.S. Cl.
USPC ..... 215/330

(58) Field of Classification Search
USPC ..... 215/330, 331
See application file for complete search history.

(56) References Cited

U.S. PATENT DOCUMENTS

| | | | |
|---|---|---|---|
| 261,131 | A | 7/1882 | Bonshiee |
| 2,201,205 | A | 5/1940 | Samburg |
| 3,930,592 | A | 1/1976 | Dilanni |
| 4,116,350 | A | 9/1978 | Allasia |
| 4,121,731 | A | 10/1978 | Okerstrum |
| 4,288,006 | A | 9/1981 | Clover, Jr. |
| 4,398,491 | A | 8/1983 | Fridl et al. |
| 4,485,963 | A | 12/1984 | Panicci |

(Continued)

FOREIGN PATENT DOCUMENTS

| | | |
|---|---|---|
| JP | 2006008187 | 1/2006 |

OTHER PUBLICATIONS

U.S. Appl. No. 13/192,438, filed Jul. 27, 2011, Dunn et al.
U.S. Appl. No. 13/192,440, filed Jul. 27, 2011, Dunn et al.

(Continued)

*Primary Examiner* — Steven A. Reynolds
*Assistant Examiner* — King M Chu
(74) *Attorney, Agent, or Firm* — Robert Z. Evora, Esq.

(57) ABSTRACT

A spillproof container assembly includes a container body and a lid body that is adapted to be fastened onto the container body by screwing. Both the container body and the lid body are advantageously provided with outwardly extending wing portions for enhancing the grippability of and properly orienting the container assembly for small children. The outwardly extending wing portions of the container body are aligned with the outwardly extending wing portions of the lid body. The lid body is provided with an acoustic waveguide, and sound generating structure is provided in communication with the acoustic waveguide for creating an audible feedback when the lid body has been tightened onto the container body to a predetermined relative position and tightness. The acoustic waveguide further functions as a viewing port that provides a visual feedback so that a user can visually verify the position of the lid body with respect to the container body. In addition, the wing portions of the lid body are designed to slightly interfere with and cam over respective upper platforms on the wing portions of the container body so that a user will be provided with a tactical feedback as a lid body is approaching an optimal amount of tightness with respect to the container body.

7 Claims, 19 Drawing Sheets

(56) References Cited

U.S. PATENT DOCUMENTS

| | | | | |
|---|---|---|---|---|
| 4,489,834 | A | | 12/1984 | Thackrey |
| 5,102,000 | A | | 4/1992 | Feltman |
| 5,147,066 | A | | 9/1992 | Snider |
| 5,211,303 | A | | 5/1993 | Mosior |
| 5,299,701 | A | | 4/1994 | Barker et al. |
| 5,480,043 | A | | 1/1996 | Wingo |
| 5,839,581 | A | | 11/1998 | Vagedes |
| 6,037,872 | A | | 3/2000 | Dunnum |
| 6,039,197 | A | | 3/2000 | Braun |
| 6,105,801 | A | * | 8/2000 | Minnette ..... 215/44 |
| 6,508,379 | B1 | | 1/2003 | Van De Pol-Klein Nagelvoort et al. |
| D486,996 | S | | 2/2004 | Karp |
| D491,063 | S | | 6/2004 | Hicks et al. |
| 6,783,020 | B2 | | 8/2004 | Featherston et al. |
| 6,811,047 | B1 | | 11/2004 | Hicks et al. |
| 6,880,713 | B2 | | 4/2005 | Holley, Jr. |
| 6,902,079 | B2 | | 6/2005 | Hagano |
| 6,907,121 | B1 | | 6/2005 | Andersson |
| D579,332 | S | | 10/2008 | Krivoshein |
| D584,102 | S | | 1/2009 | Valderrama et al. |
| 7,562,789 | B2 | | 7/2009 | Randolph et al. |
| 7,651,005 | B2 | | 1/2010 | Nguyen et al. |
| D609,527 | S | | 2/2010 | Roehrig et al. |
| D609,528 | S | | 2/2010 | Roehrig et al. |
| D620,309 | S | | 7/2010 | Boonprasop |
| D620,315 | S | | 7/2010 | Boonprasop |
| D624,434 | S | | 9/2010 | Schaeffer et al. |
| D628,078 | S | | 11/2010 | Valderrama et al. |
| D642,437 | S | | 8/2011 | Schofield et al. |
| D644,067 | S | | 8/2011 | Valderrama et al. |
| D656,788 | S | | 4/2012 | Sakulsacha |
| D675,062 | S | | 1/2013 | Dunn et al. |
| 2004/0124196 | A1 | | 7/2004 | Ziegler |
| 2004/0200797 | A1 | | 10/2004 | Hicks et al. |
| 2005/0133475 | A1 | | 6/2005 | Goto et al. |
| 2006/0213912 | A1 | | 9/2006 | Zaytoun |
| 2009/0071962 | A1 | | 3/2009 | Lindsay |
| 2009/0242562 | A1 | | 10/2009 | Valderrama et al. |
| 2010/0051572 | A1 | * | 3/2010 | Beecroft et al. ..... 215/216 |
| 2010/0147862 | A1 | | 6/2010 | Keefe et al. |

OTHER PUBLICATIONS

U.S. Appl. No. 13/192,441, filed Jul. 27, 2011, Dunn et al.
U.S. Appl. No. 29/374,940, filed Oct. 26, 2011, Dunn et al.
International Search Report and Written Opinion for PCT/US2012/040642, Dec. 4, 2013, (6 pages).

* cited by examiner

CONTAINER FOR SPILLPROOF CONTAINER ASSEMBLIES

This is a nonprovisional of U.S. provisional patent application 61/493,132, filed Jun. 3, 2011, the entire disclosure of which is hereby incorporated by reference as if set forth fully herein.

BACKGROUND OF THE INVENTION

1. Field of the Invention

This invention relates generally to the field of feeding accessories, and more particularly to spillproof container assemblies, such as those that can be used as training cups for toddlers.

2. Description of the Related Technology

A wide variety of spillproof container assemblies, such as those that are used as training cups for toddlers, have been commercially available for decades. Such products typically include a container body such as a cup or baby bottle and a lid that is constructed and arranged to form a seal with respect to the container body. The lid is provided with an opening to permit controlled passage of fluid from the cup body for drinking purposes.

In some products, the lid is provided with a valve mechanism that seals the opening unless drinking suction is applied to the opening by a user, or that seals the opening until the drinking cup assembly is inverted. In other products, the drinking opening in the lid is unrestricted, but a valve is provided within a second opening in the lid to impede the entry of makeup air into the cup body, except when suction is being applied to the drinking opening.

Another type of spillproof container assembly includes a lid that is provided with an integral flexible straw that is movable between a crimped or folded position in which the lumen of the straw is substantially closed and an extended position in which the lumen is open throughout the length of the straw. In the latter position, free passage of fluid is permitted through the straw, enabling a user to drink through the straw. In other products, the lid is provided with an integral drinking spout that extends upwardly from the rest of the lid.

For purposes of this document, a spill resistant container assembly shall be considered spillproof. A spill resistant container assembly is typified by an unrestricted opening in the lid that is sized small enough to limit the amount of fluid that can be spilled if the container assembly is dropped or inverted.

In most spillproof drinking cup assemblies, the lid and the cup body are provided with mating helical threads to enable the lid to be securely fastened onto the cup body by screwing. If the lid is not fully screwed onto the cup body, both leakage of fluid and undesirable entry of makeup air into the cup body can occur. On the other hand, if the lid is overtightened with respect to the cup body, undesirable deformation of the threads and sealing surfaces of the product can occur, and the lid can be a difficult to remove by the consumer. A lid that is difficult to remove because it is too tightly fastened onto the cup body can itself lead to spilling of the contents of the cup body as the user struggles to remove the lid.

Small children in the age range that typically use training cups do not have the hand eye coordination of older children or adults. The lid portion of most spillproof drinking cup assemblies that includes the drinking straw or spout is typically asymmetrical, requiring a small child to hold the drinking cup assembly during drinking in an orientation that properly positions the straw or drinking spout with respect to his or her mouth. It is difficult for many small children to securely grip many commercially available training cups while they are drinking, and to achieve and maintain the optimum orientation for drinking.

In addition, both the lids and the cup bodies of most commercially available spillproof cup assemblies are typically substantially cylindrical in transverse cross-section. They can be difficult for a caregiver to grip during tightening and untightening of the lid onto the cup body, particularly if the article is wet with rinse water or condensate.

There is therefore a need for a spillproof container assembly that provides guidance to consumers as to the proper degree of tightening between the lid and the container body. There is also a need for a spillproof drinking cup assembly that is constructed and arranged to optimize grippability for both small children and caregivers as well as promote optimum orientation of the container assembly by a small child during use.

SUMMARY OF THE INVENTION

Accordingly, it is an object of the invention to provide a spillproof container assembly that provides guidance to consumers as to the proper degree of tightening between the lid and the container body.

It is further an object of the invention to provide a spillproof container assembly that is constructed and arranged to optimize grippability for small children and caregivers, as well as promoting optimum orientation of the container assembly by a small child during use.

In order to achieve the above and other objects of the invention, a lid for a spillproof drinking assembly according to a first aspect of the invention includes an inner surface having at least one thread defined thereon; a rounded main body and a first wing protruding from a first side of the rounded main body that facilitates gripping of the lid by a user.

A lid for a child's container according to a second aspect of the invention includes a lid body; securement structure for facilitating releasable attachment of the lid body to a container body; a drinking opening defined in the lid body for permitting the passage of fluid through the lid body to a user for purposes of drinking; and an acoustic waveguide defined in the lid body for transmitting a sound to the user.

A lid for a spillproof drinking assembly according to a third aspect of the invention includes a lid body; securement structure for facilitating releasable attachment of the lid body to a container body; a drinking opening defined in the lid body for permitting the passage of fluid through the lid body to a user for purposes of drinking; and a viewing port defined in the lid body for viewing a portion of the container body in order to verify proper alignment of the lid body and the container body when the lid body is being secured to the container body.

A spillproof container assembly according to a fourth aspect of the invention includes a lid having a generally circular lid main body, a first lid wing protruding from a first side of the lid main body and a second lid wing protruding from a second, opposite side of the lid main body; and a container having a generally circular container main body, a first container wing protruding from a first side of the container main body and a second container wing protruding from a second, opposite side of the container main body, and wherein the first lid wing is substantially aligned with the first container wing, and the second lid wing is substantially aligned with the second container wing.

A spillproof container assembly according to a fifth aspect of the invention includes a container body having a first mounting thread and a visual indicator provided on an upper surface thereof; a lid body having a second mounting thread that is adapted to engage the first mounting thread so that the lid body may be fastened to the container body by screwing, the lid body having a viewing port defined therein; and wherein the lid body and the container body are constructed and arranged so that the visual indicator is visible through the viewing port when the lid body is screwed onto the container body with a predetermined tightness.

A spillproof container assembly according to a sixth aspect of the invention includes a container body; a lid body that is constructed and arranged to the fastened to the container body by screwing, the lid body having an acoustic waveguide defined therein; and structure in communication with the acoustic waveguide for producing an audible feedback when the lid body is screwed onto the container body with a predetermined tightness.

A container for a spillproof drinking assembly according to a seventh aspect of the invention includes a bottom portion; a main body portion having an main body, the main body being substantially round as viewed in top plan and a first wing protruding from a first side of the main body in order to enhance grippability of the container for a small child.

A container for a spillproof drinking assembly according to an eighth aspect of the invention includes a bottom portion; a main body portion having an upper portion and a first wing protruding from a first side of the upper portion of the main body that has an upper platform defined therein.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
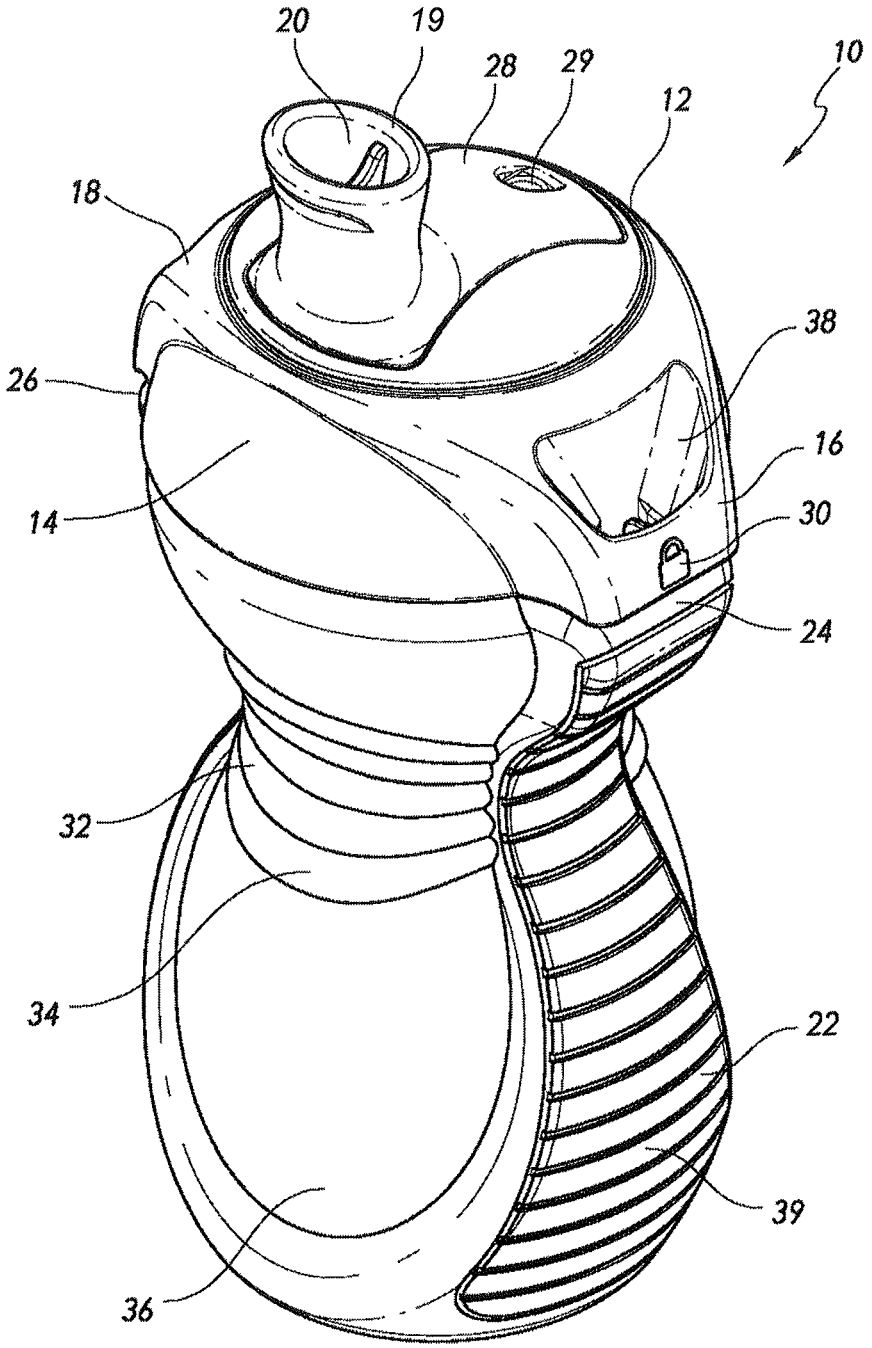
FIG. 1 is a perspective view of a spillproof container assembly that is constructed according to a preferred embodiment of the invention.
Figure 2:
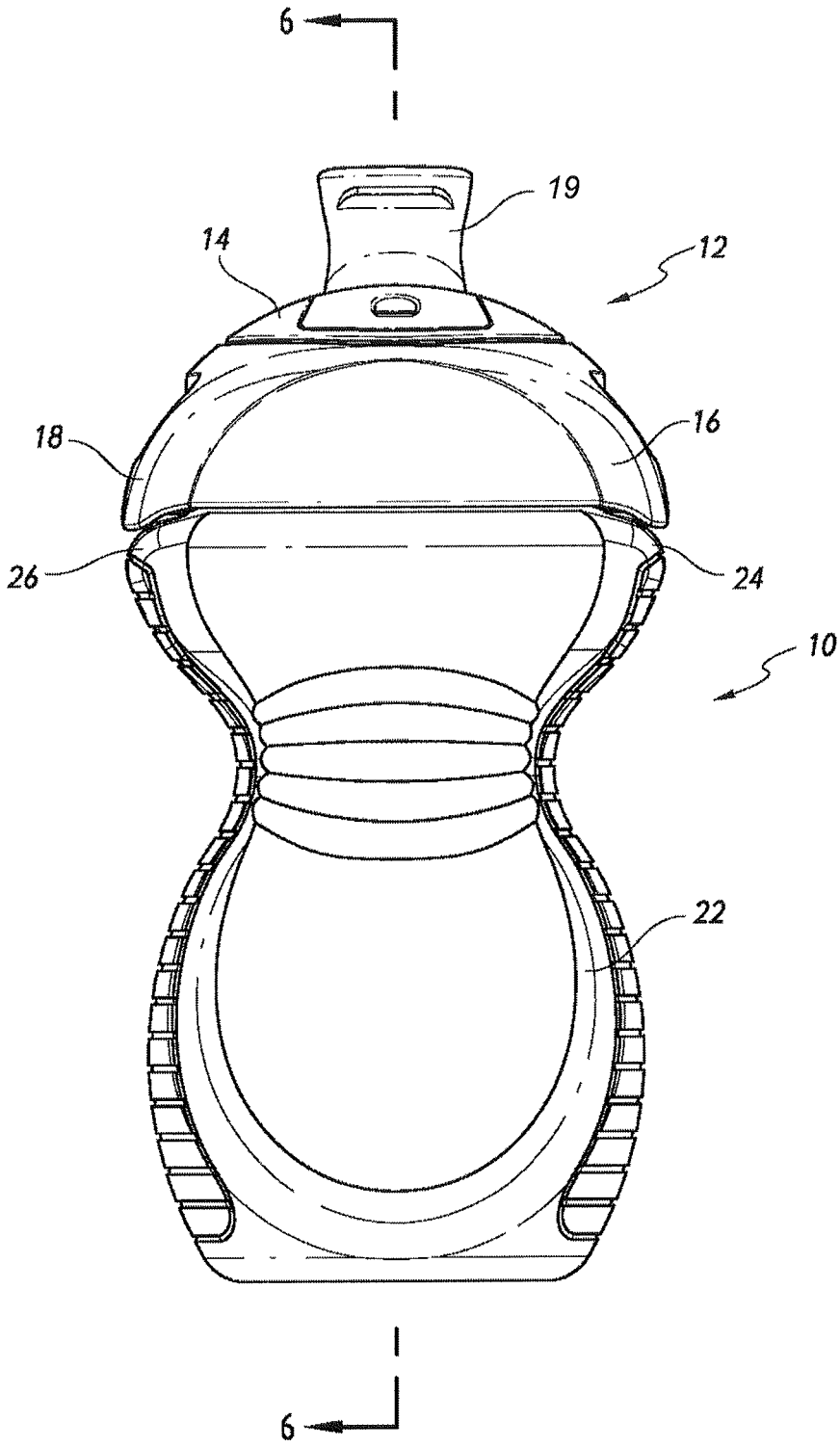
FIG. 2 is a front elevational view of the spillproof container assembly that is shown in FIG. 1.
Figure 4:
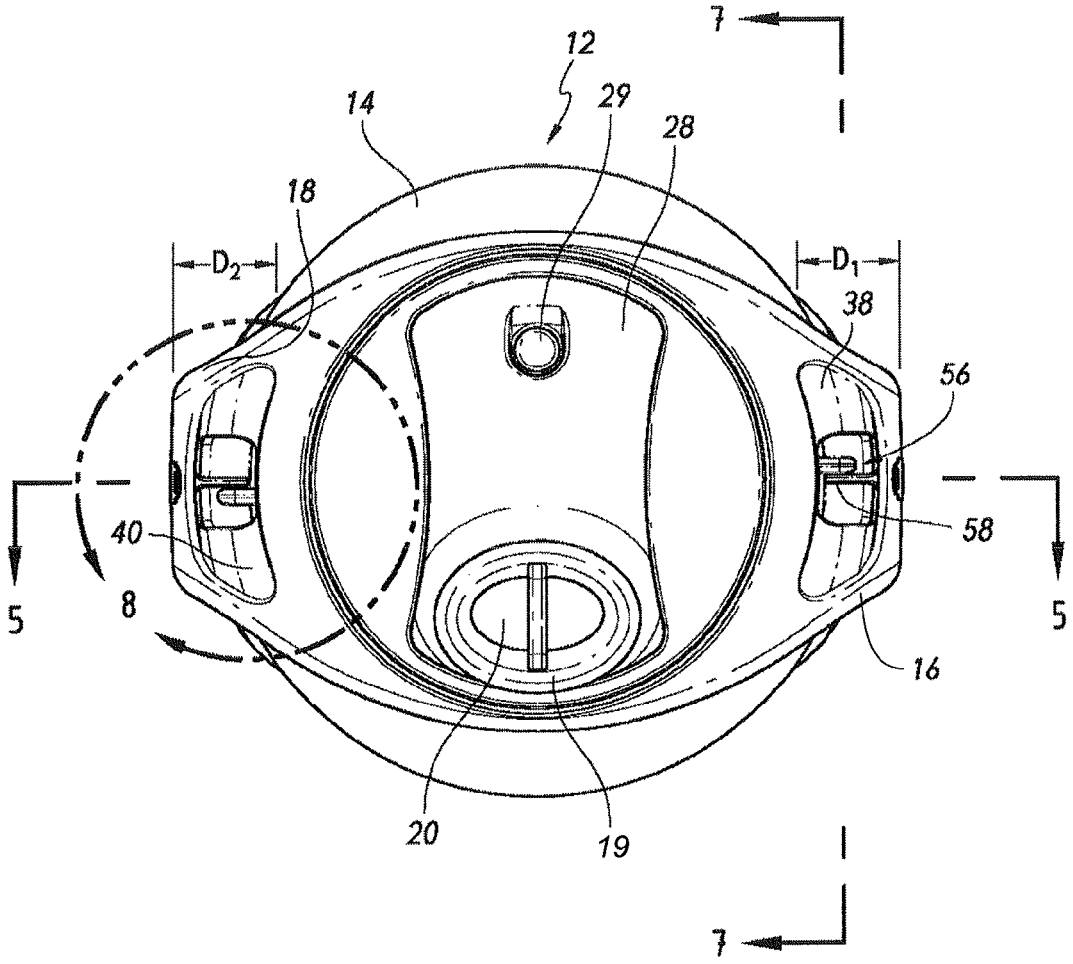
FIG. 4 is a top plan view of the spillproof container assembly that is shown in FIG. 1.

Referring now to the drawings, wherein like reference numerals designate corresponding structure throughout the views, and referring in particular to FIG. 1, a spillproof container assembly 10 that is constructed according to a first, preferred embodiment of the invention includes a lid body 12 that has a generally circular lid main body 14 as viewed in top plan, best seen in FIG. 4.

Lid body 12 includes at least one lid wing that protrudes radially outwardly from a first side of the main body 14. In the preferred embodiment, lid body 12 includes a first lid wing 16 that protrudes radially outwardly from a first side of the lid main body 14, and a second lid wing 18 that protrudes radially outwardly from a portion of the lid main body 14, which is preferably on a second side that is opposite the first side. The lid wings 16, 18 are preferably substantially diametrically opposed. Alternatively, the lid wings 16, 18 could be positioned so that they are located as if at 2:30 and 9:30 on a clock.

A lid wing by definition forms part of the sidewall of the lid body. A solid handle that extends outwardly from a lid is not to be considered a lid wing for purposes of this document.

Alternatively, the lid body could be fabricated to have just a single lid wing, or multiple lid wings that may be spaced circumferentially about the outer periphery of the lid body. For example, the lid body could have three lid wings that are spaced 120° apart.

The lid body 12 is preferably constructed and arranged to receive a flexible insert 28, which has a makeup air valve 29 integrally formed therein. The flexible insert 28 is preferably fabricated from a flexible material such as silicone and preferably defines an upstanding drinking spout 19, which has an opening 20 defined therein that is in communication with an interior space of the cup assembly 10 that may hold liquid such as a beverage. In the preferred embodiment, the opening in the lid body 12 for receiving the flexible insert 28 is symmetrical so that the flexible insert 28 can be inserted facing in either direction.

Figure 5:
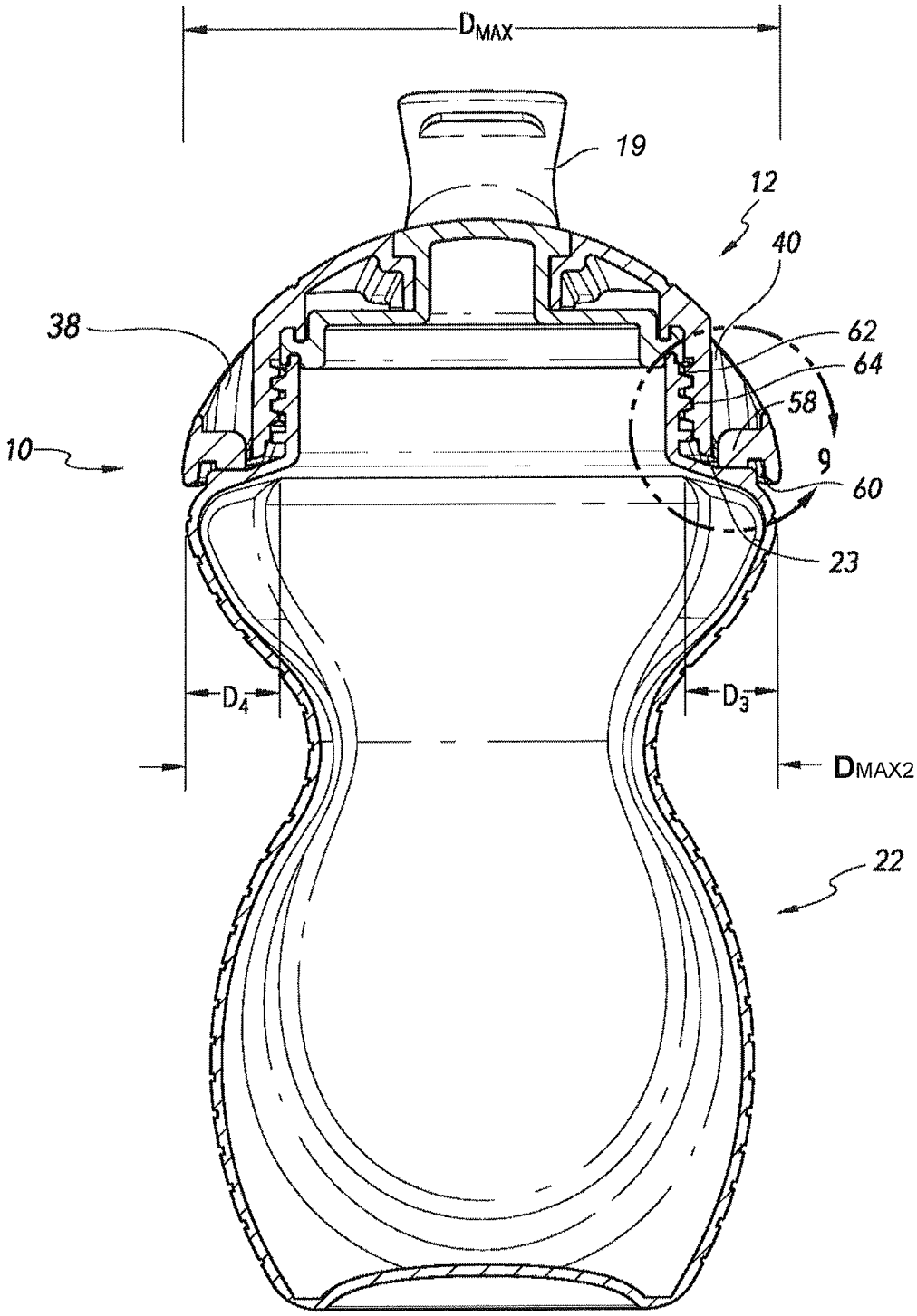
FIG. 5 is a cross-sectional view taken along lines 5-5 in FIG. 4.
Figure 6:
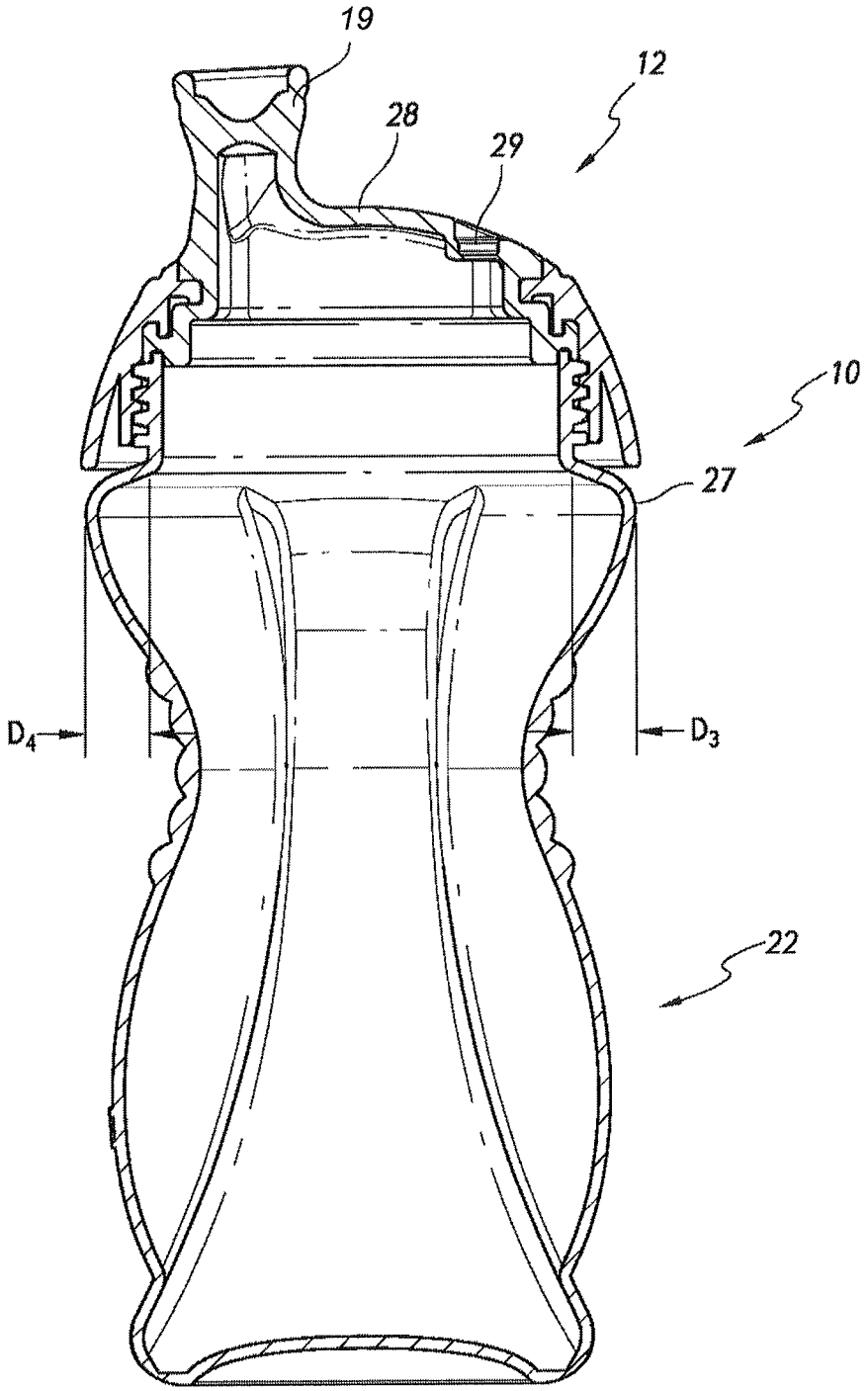
FIG. 6 is a cross-sectional view taken along lines 6-6 in FIG. 2.
Figure 7:
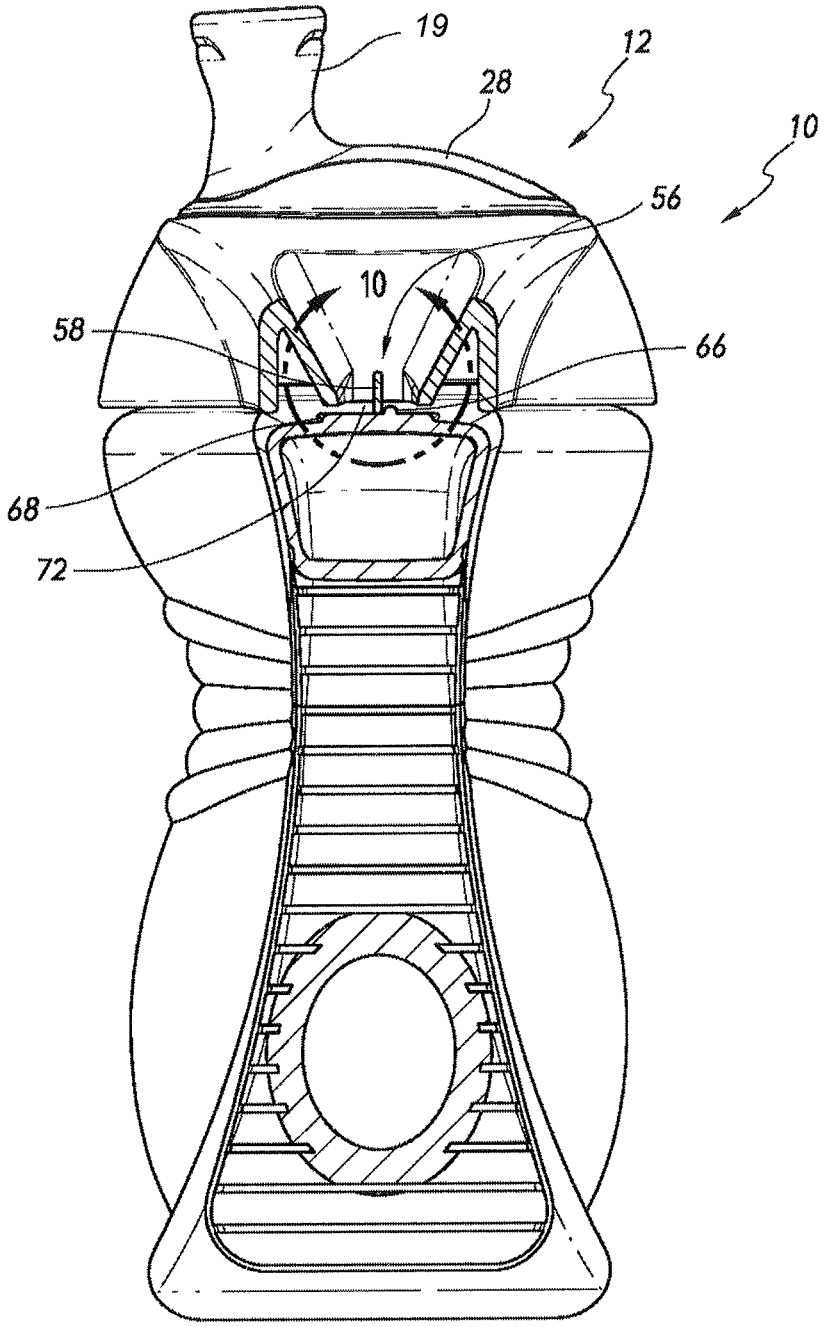
FIG. 7 is a cross-sectional view taken along lines 7-7 in FIG. 4.

The spillproof drinking cup assembly 10 further includes a container body, which in the preferred embodiment is a cup body 22 having a generally circular main body 23, as may be seen in FIG. 5. The cup body 22 is also shown in perspective without the lid body 12 in FIG. 11. Alternatively, the container body could be a baby bottle, bowl, snack trap or any other type of container that is constructed and arranged to receive a lid. Preferably, cup body 22 has a volumetric capacity that is less than about 30 ounces, more preferably less than about 20 ounces and most preferably less than about 12 ounces.

Cup body 22 includes at least one container wing or cup wing that protrudes radially outwardly from a first side of the cup main body 23, which enables a consumer to grip and exert torque on the cup body 22 during tightening and untightening of the lid body 12. In the preferred embodiment, the cup body 22 includes a first cup wing 24 that protrudes radially outwardly from a first side of the cup main body 23 and a second cup wing 26 that protrudes radially outwardly from a second, opposite side of the cup main body 23. The respective cup wings 24, 26 both preferably form part of the upper surface of the cup body 22. The cup wings 24, 26 are preferably substantially diametrically opposed, but could be positioned so that they are not diametrically opposed, such as if they were located at 2:30 and 9:30 on a clock.

For purposes of this document, a cup wing shall be considered to be integral with and form part of the interior of the sidewall of the container that contains beverage or other fluid therein. For example, an external accessory such as a solid handle shall not be considered a cup wing for purposes of this document.

Alternatively, the container body could be provided with a single container wing, or multiple container wings. By grasping the wings on the lid and the container body, a user is able to more conveniently exert relative torque between the lid and the cup body in order to tighten and untighten the lid onto the cup.

The container body could be embodied within the ambit of the invention as a container other than a cup, such as a baby bottle or a bowl.

Figure 3:
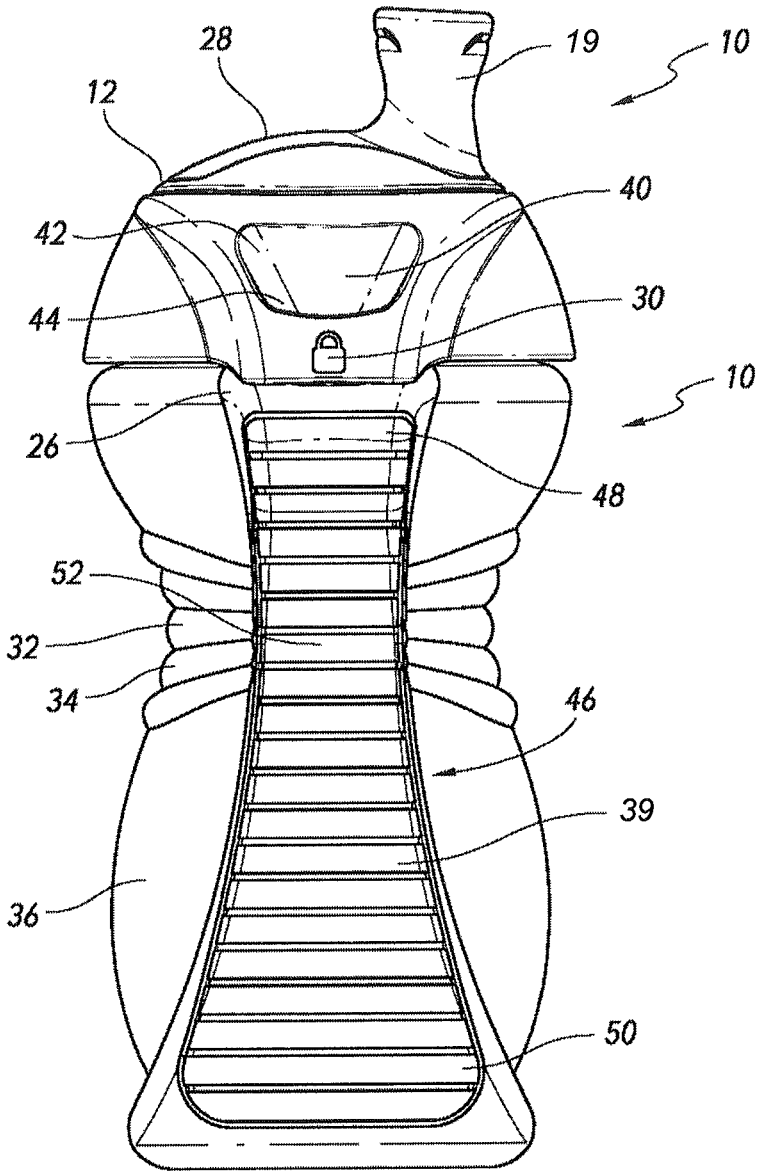
FIG. 3 is a side elevational view of the spillproof container assembly that is shown in FIG. 1.

Each of the cup wings 24, 26 is preferably tapered so as to decrease in width as viewed in top plan as it extends away from the generally circular main body 23. In addition, each cup wing 24, 26 preferably has a distal surface 27 that is substantially flat. Moreover, as is best shown in FIG. 3, each of the cup wings 24, 26 preferably is tapered as viewed in side elevation so as to decrease in width from top to bottom.

Both the lid body 12 and the cup body 22 are preferably fabricated from a plastic material such as polypropylene, polyethylene or high-density polyethylene using a process such as injection molding.

As may best be seen in FIG. 5, the lid body 12 is constructed and arranged to be screwed onto the cup body 22. In order to enable this, at least one helical lid thread 62 is provided on an inner circumferential surface of the lid body 12, which mates with at least one helical cup thread 64 that is defined on an outer circumferential surface of the circular main body 23 of the cup body 22.

Preferably, the first lid wing 16 is substantially aligned with the first cup wing 24 and the second lid wing 18 is substantially aligned with the second cup wing 26 when the lid body 12 is screwed onto the cup body 22 to a predetermined optimum tightness and relative position. As will be described in greater detail below, the spillproof drinking cup assembly 10 provides visual, audible and tactical feedback to a user in determining when the optimum design tightness and position has been reached between the lid body 12 and the cup body 22.

In the preferred embodiment, the first lid wing 16 has a first viewing port 38 defined therein, and the second lid wing 18 has a second viewing port 40 defined therein. Preferably, a portion of the first cup wing 24 is visible through the first viewing port 38 and a portion of the second cup wing 26 is viewable through the second viewing port 40 when the lid body 12 has been tightened onto the cup body 22 to the predetermined optimum closed position and tightness.

In the preferred embodiment, a visual indicator 72 is provided on a platform 68 located on an upper portion of the respective cup wing 24, 26 that is viewable through the respective viewing port 38, 40. Preferably, the visual indicator 72 is a different color from at least a portion of the surface defining the respective viewing port 38, 40.

Figure 11:
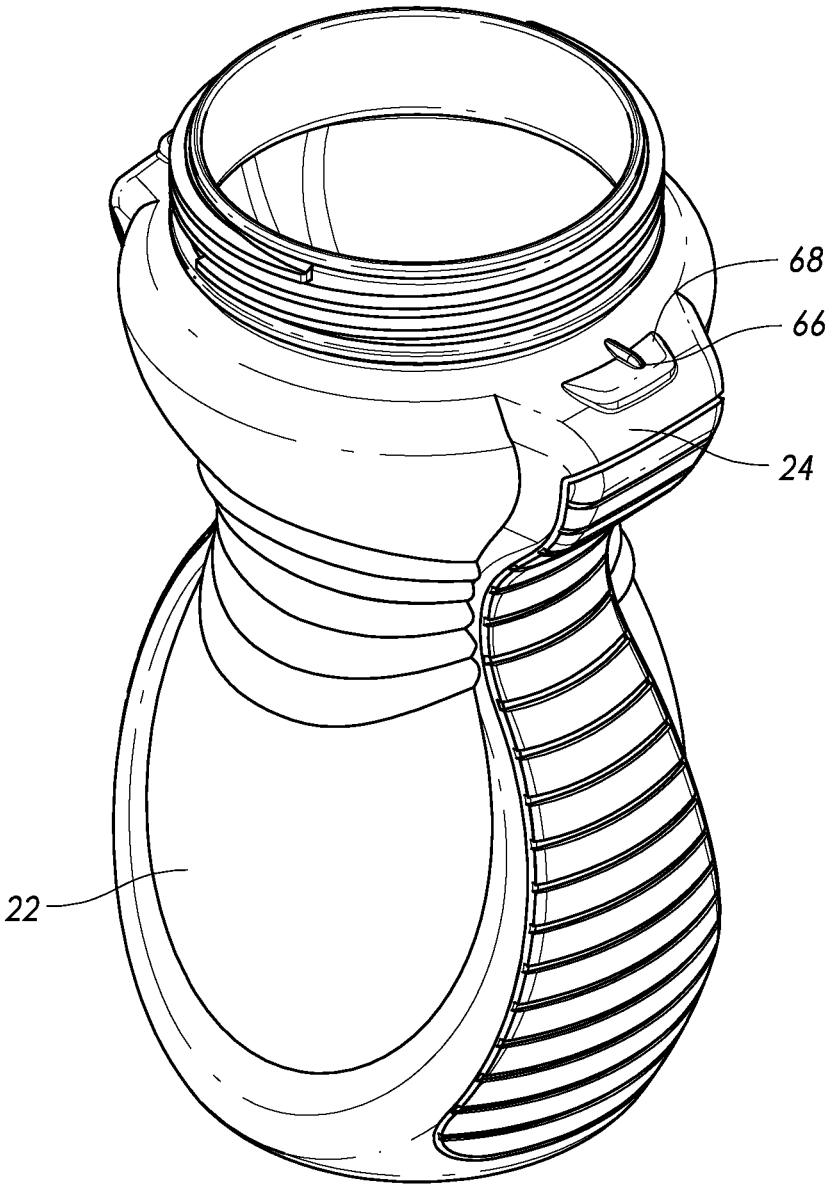
FIG. 11 is a perspective view depicting a container body that is constructed according to a preferred embodiment of the invention.

As may best be seen in FIG. 11, the platform 68 is preferably substantially flat, and is further preferably substantially disposed within a plane that is substantially normal to a longitudinal axis of the cup body 22. The platform 68 preferably forms part of an upper surface of the cup body 22. Platform 68 preferably has an area that is substantially within a range of about 25 mm to about 1000 mm, more preferably substantially within a range of about 35 mm to about 600 mm and most preferably substantially within a range of about 45 mm to about 350 mm.

The first and second lid wings 16, 18 preferably substantially correspond in size and shape, particularly in their extent of radial projection, to the first and second cup wings 24, 26. Preferably, the first and second lid wings 16, 18 are substantially symmetrical to each other and substantially identical in size and in shape. Similarly, the first and second cup wings 24, 26 are preferably substantially symmetrical to each other and substantially identical in size and shape.

Referring to FIG. 4, it will be seen that the first lid wing 16 extends radially outwardly from the lid main body 14 by a first distance $D_1$, and the second lid wing 18 extends radially outwardly from the lid main body 14 by a second distance $D_2$, which is preferably substantially identical to the first distance $D_1$. As FIG. 5 shows, the lid body 12 has a maximum lateral dimension $D_{MAX}$, while the cup body 22 has a maximum lateral dimension $D_{MAX2}$.

In the preferred embodiment, a ratio $D_1/D_{MAX}$ of the radial projection of the lid wing 16 to the maximum lateral extent of the lid body 12 is substantially within a range of about 0.03 to about 0.25, more preferably substantially within a range of about 0.04 to about 0.20 and most preferably substantially within a range of about 0.05 to about 0.16.

Figure 8:
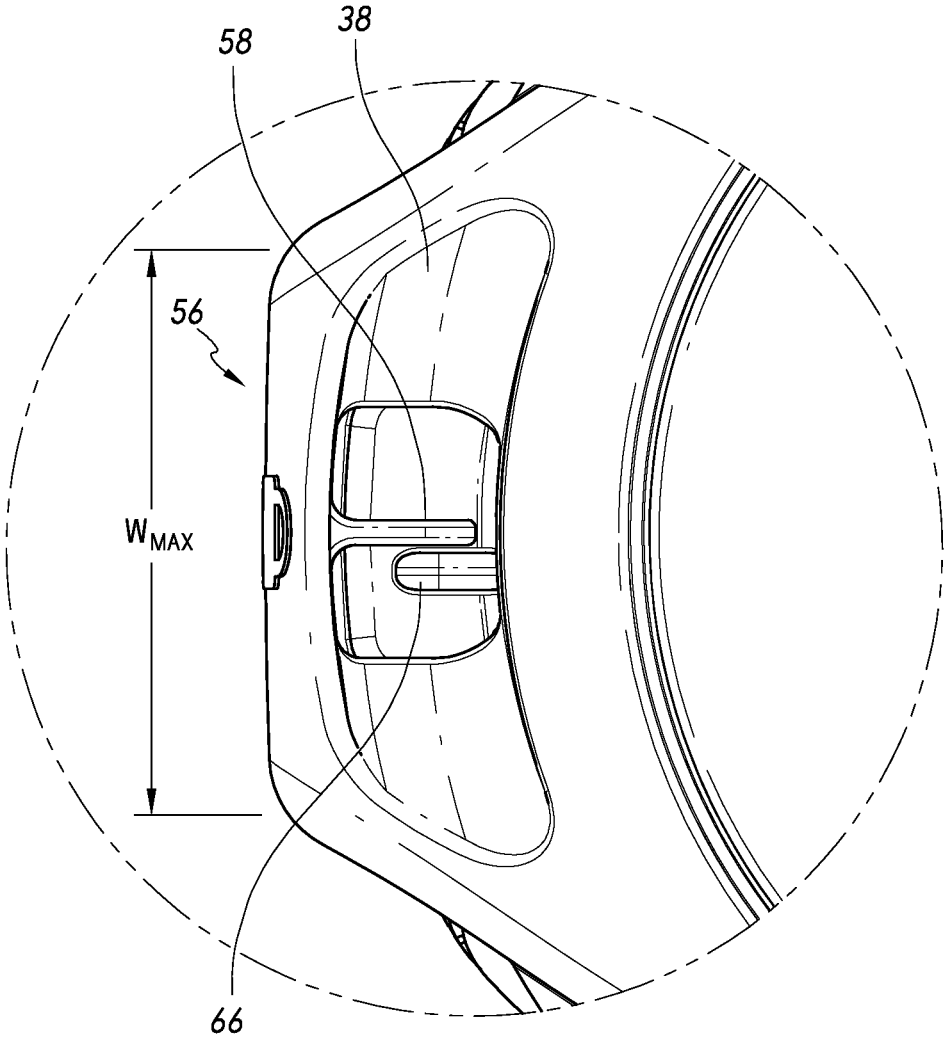
FIG. 8 is a fragmentary top plan view showing a portion of the spillproof container assembly that is shown in FIG. 1.

Each of the lid wings 16, 18 further has a maximum width $W_{MAX}$ as measured on its outermost surface, as is best shown FIG. 8. Preferably, a ratio of the maximum width $W_{MAX}$ to the maximum lateral extent $D_{MAX}$ of the lid body 14 is substantially with a range of about 0.3 to about 0.85, more preferably substantially within a range of about 0.35 to about 0.8 and most preferably substantially within a range of about 0.4 to about 0.7.

Preferably, as is also shown in FIG. 5, the first cup wing 24 extends radially outwardly from the cup main body 23 by a third distance $D_3$, while the second cup wing 26 extends radially outwardly from the cup main body 23 by a fourth distance $D_4$, which is preferably substantially identical to the third distance $D_3$. Preferably, the distances $D_3$, $D_4$ are based are at least substantially about 0.1 inch and more preferably at least substantially about 0.2 inch.

In the preferred embodiment, a ratio $D_3/D_{MAX2}$ of the radial projection of the first cup wing 24 to the maximum lateral dimension $D_{MAX2}$ of the cup body 22 is substantially within a range of about 0.03 to about 0.25, more preferably substantially within a range of about 0.04 to about 0.20 and most preferably substantially within a range of about 0.05 to about 0.16.

Preferably, the first distance $D_1$ is substantially the same as the third distance $D_3$, while the second distance $D_2$ is preferably substantially the same as the fourth distance $D_4$. In other words, the cup wings 24, 26 preferably protrude radially to about the same extent as the respective lid wings 16, 18.

As FIG. 1 shows, indicia 30 may be provided on the lid body 12, preferably on an outer surface of one or more of the lid wings 16, 18, to indicate to a user that tactile, visual and audible feedback is available to verify that the lid body 12 has been fully screwed onto the cup body 22. In the preferred embodiment, indicia 30 is embodied as a lock icon.

Preferably, the cup body 22 is generally hourglass shaped, having a narrowed waist 32 that is provided with a plurality of gripping ribs 34 and an expanded bottom, or lower portion 36. The cup body 20 to further preferably has a textured side panel 46, best visible on FIG. 3, with a plurality of gripping ribs 39. The textured side panel 46 preferably has an hourglass shape, with an upper end 48 that merges into a lower portion of the respective cup wing 24, 26, a larger lower end 50 and a narrowed central portion 52.

Structure 56 for providing audible feedback when the lid body 12 reaches a predetermined position in which it has been optimally positioned and tightened with respect to the cup body 22 is best shown in FIGS. 4 and 7-10. In the preferred embodiment, the structure 56 for providing audible feedback includes a first portion that is defined on at least one of the lid wings 16, 18 and a second portion that is defined on at least one of the cup wings 24, 26.

Most preferably, the structure 56 for providing audible feedback includes an acoustic waveguide 78 on both of the lid wings 16, 18 that is defined as part of the respective viewing port 38, 40, and a flexible tab 58 that is cantilevered inwardly into the viewing port 38, 40 from an outboard side 60 of the sidewall defining the respective viewing port 38, 40. By connecting the flexible tab 58 to the outboard side 60 as opposed to the inboard side, interruption of the cup threads 64 is avoided.

Figure 9:
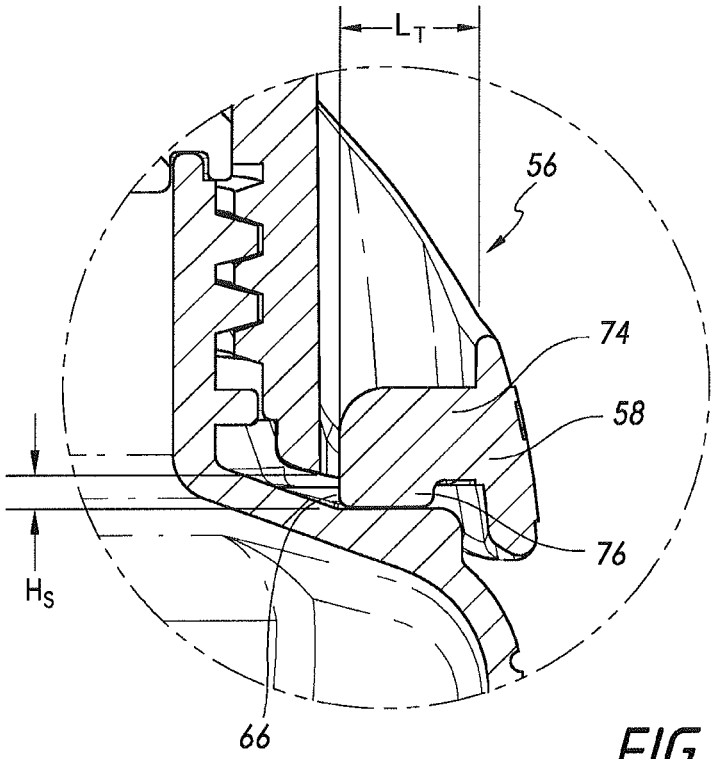
FIG. 9 is a fragmentary cross-sectional view showing a portion of the spillproof container assembly that is shown in FIG. 1.
Figure 10:
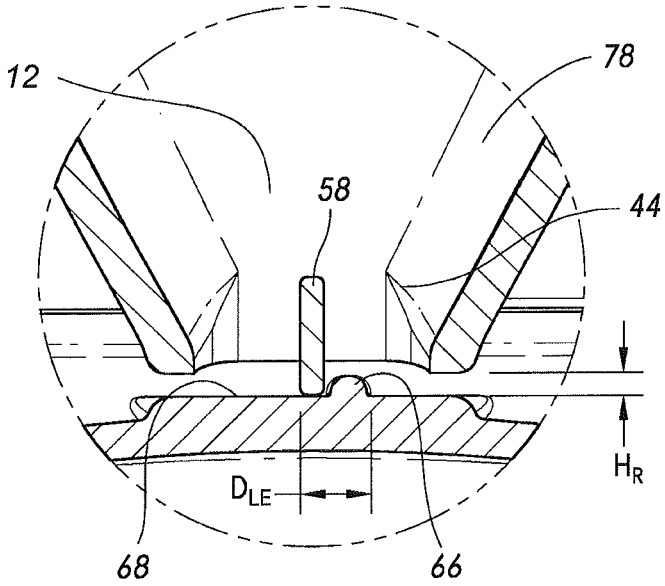
FIG. 10 is another fragmentary cross-sectional view showing a portion of the spillproof container assembly that is shown FIG. 1.

As FIG. 9 shows, the flexible tab 58 preferably has a horizontal leg 74 that has a first length $L_T$, and a vertical leg 76 that extends downwardly from the horizontal leg 74 and has a height $H_S$. Accordingly, the flexible tab 58 is preferably L-shaped. Height $H_S$ is preferably substantially within a range from about 2 mm to about 10 mm, more preferably substantially within a range of about 3 mm to about 9 mm and most preferably substantially within a range of about 4 mm to about 7 mm.

The flexible tab 58 is preferably fabricated from a relatively hard plastic material such as polypropylene, ABS, polyvinyl chloride, nylon or polyethylene terephthalate. Preferably, the flexible tab 58 has a modulus of elasticity that is substantially within a range of about 0.0001 to about 25 GPa, more preferably substantially within a range about 0.0008 to about 18 GPa, and most preferably substantially within a range of about 0.00159 to about 12.1 GPa.

Additionally, flexible tab 58 preferably has a hardness that is substantially within a range of about 10 to about 150 Rockwell R, more preferably substantially within a range of about 15 to about 130 Rockwell R and most preferably substantially within a range of about 20 to about 117 Rockwell R.

The flexible tab 58 is preferably mounted so that it is in acoustic communication with the respective port 38, 40, and is more preferably positioned within the respective port 38, 40, which is also the acoustic waveguide 78.

The structure 56 for providing audible feedback further preferably includes a snap projection for engaging and temporarily restraining the flexible tab 58 while the lid body moves with respect to the cup body 22 toward the predetermined optimum closed position. In the preferred embodiment, the snap projection is embodied as a snap ridge 66 that projects upwardly from the raised platform 68 that is located at the uppermost portion of the respective cup wing 24, 26. Alternatively, the snap projection could be a single or multiple bumps or posts, which could work individually or as a group to engage the flexible tab 58.

The snap ridge 66 preferably has a height $H_R$ that is substantially within a range of about 0.1 mm to about 1.3 mm, more preferably substantially within a range of about 0.3 mm to about 1.2 mm and most preferably substantially within a range of about 0.5 mm to about 0.9 mm.

As the lid body 12 approaches the optimal predetermined position and tightness with respect to the cup body 22 as it is being screwed onto the cup body 22, the lowermost portion of the vertical leg 76 of the flexible tab 58 will travel across the upper surface of the platform 68 and engage the snap ridge 66. This causes the flexible tab 58 to flexibly deflect like a leaf spring as the lid body 12 continues to move with respect to the cup body 22, until the lowermost surface of the vertical leg 76 cams itself over the upper surface of the snap ridge 66. Preferably, the snap ridge 66 has a substantially symmetrical profile when viewed in transverse cross-section. When the upper surface of the snap ridge 66 can no longer restrain the flexible tab 58, the energy that is stored as a result of the elastic deflection of the flexible tab 58 will suddenly be released, and the flexible tab 58 will resonate within the acoustic waveguide 78. This is heard by a consumer as a distinctive clicking sound.

The clicking sound is then funneled upwardly and amplified by the acoustic waveguide 78, which is megaphone shaped, having an upper portion 42 that is wider than the lower portion 44. The clicking sound is accordingly concentrated in a given direction and the coupling of its energy to the air is optimized by the acoustic waveguide 78. The audible feedback that is provided to the consumer when the lid body 12 has reached the optimal predetermined position with respect to the cup body 22 is thus maximized.

Preferably, the flexible tab 58 is constructed and arranged to be laterally deflected during its engagement with the snap ridge by a distance $D_{LE}$ that is preferably substantially within a range of about 1 mm to about 5.5 mm, more preferably substantially within a range of about 2 mm to about 4.75 mm and most preferably substantially within a range of about 3 mm to about 4 mm.

Preferably, the structure 56 for providing audible feedback in the first lid wing 16 is synchronized with respect to that provided in the second lid wing 18 so that the clicking sounds are simultaneous. Accordingly, the snap ridge 66 on the first cup wing 24 is preferably substantially diametrically opposed to the snap ridge 66 on the second cup wing 26, and the flexible tab 58 on the first lid wing 16 is substantially diametrically opposed to the flexible tab 58 on the second lid wing 18. Alternatively, the respective structures 56 could be slightly staggered or offset from a precise diametric opposition so that the clicking sounds are sequential.

Additional embodiments of the invention are shown in FIGS. 12-20. In each of these embodiments, the function and purpose of the lid wings, cup wings and the visual, tactile and acoustic feedback systems is substantially the same as described above with respect to the preferred embodiment, and differ from the preferred embodiment only in terms of aesthetic form, the presence of additional handles and different types of drinking mechanisms.

Figure 12:
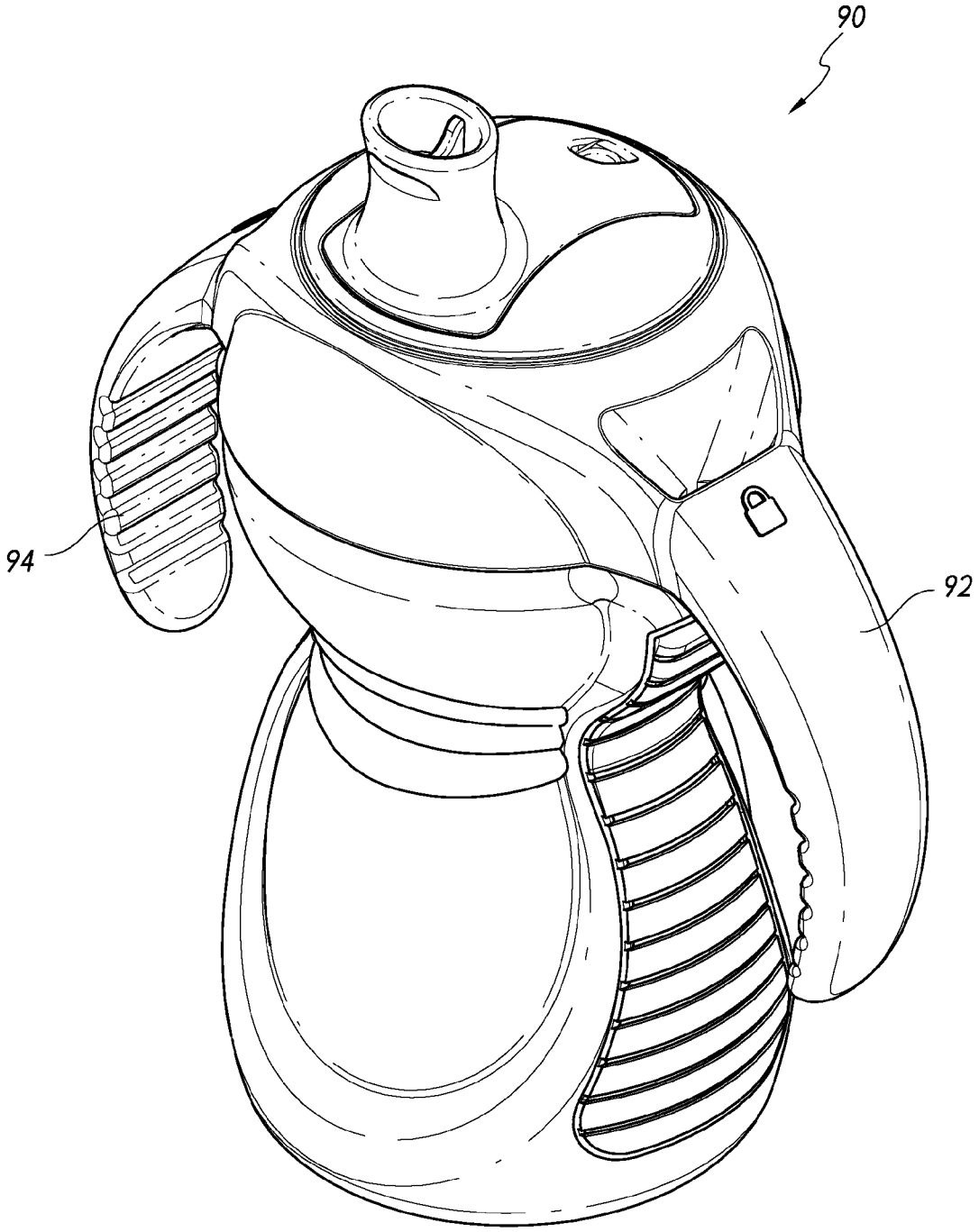
FIG. 12 is a perspective view showing a spillproof container assembly that is constructed according to a second embodiment of the invention.

FIG. 12 depicts a spillproof cup assembly 90 according to a second embodiment of the invention, in which a pair of handles 92, 94 are provided to enhance grippability.

Figure 13:
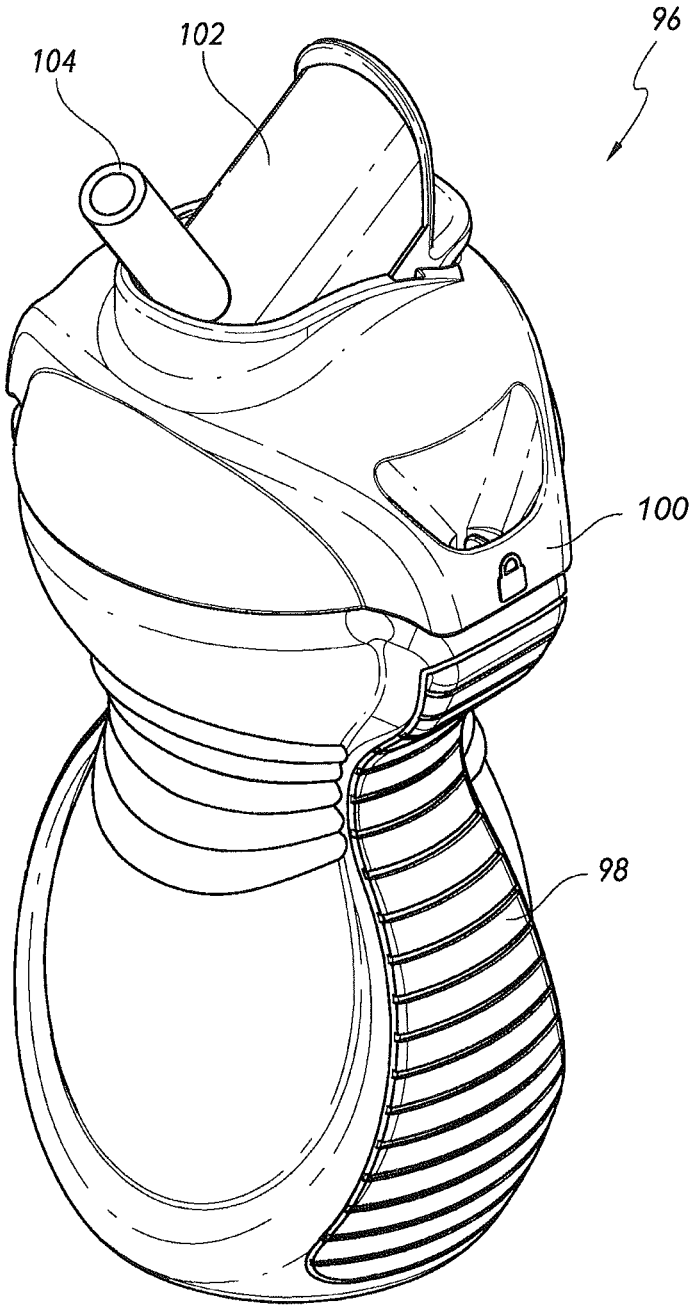
FIG. 13 is a perspective view showing a spillproof container assembly that is constructed according to a third embodiment of the invention.

FIG. 13 depicts a spillproof cup assembly 96 according to a third embodiment of the invention, having a cup body 98, a lid body 100 and a straw deployment mechanism 102 for opening and closing a drinking straw 104.

Figure 14:
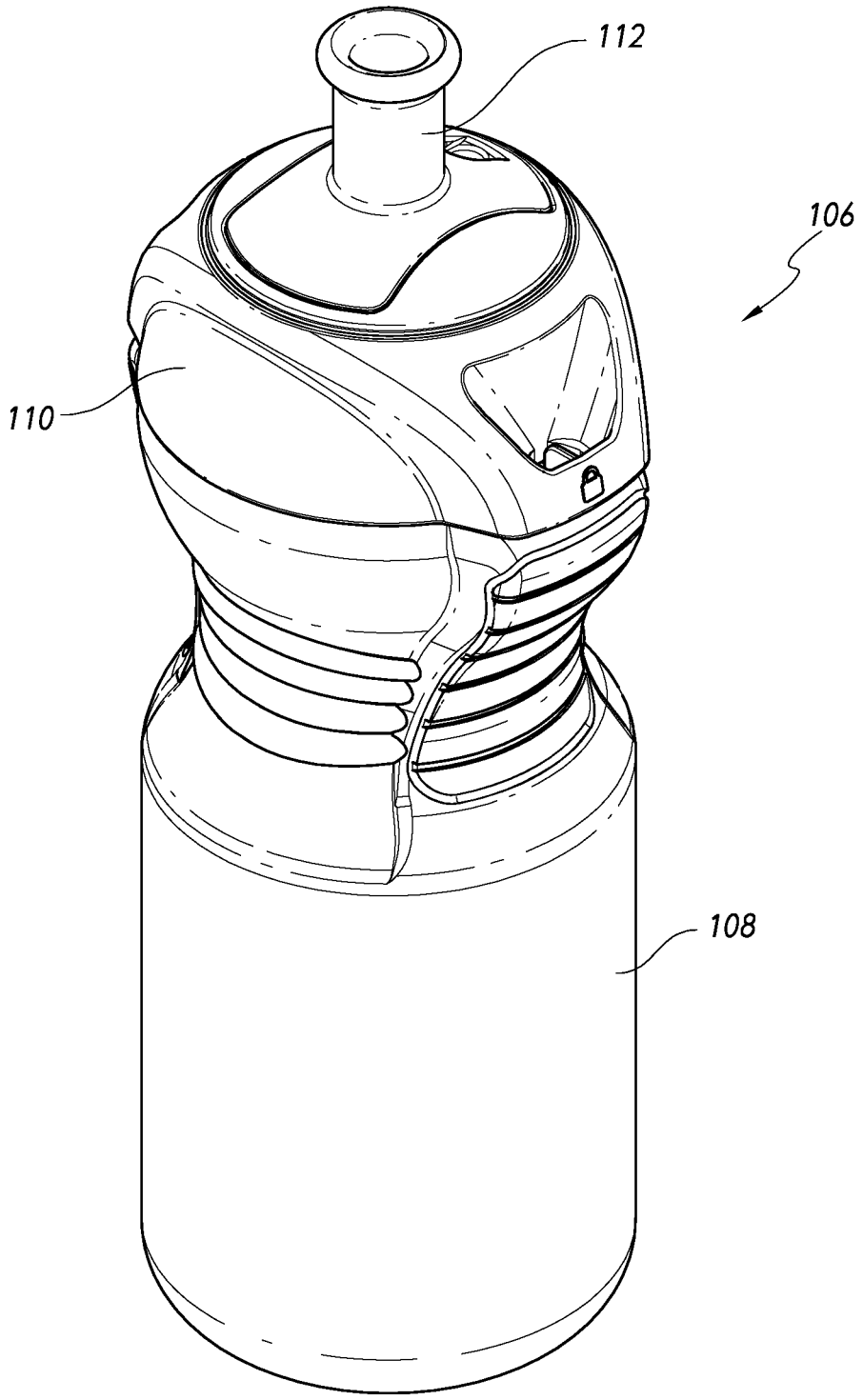
FIG. 14 is a perspective view showing a spillproof container assembly that is constructed according to a fourth embodiment of the invention.

FIG. 14 depicts a spillproof cup assembly 106 according to a fourth embodiment of the invention, having a cup body 108, a lid body 110 and a drinking spout 112.

Figure 15:
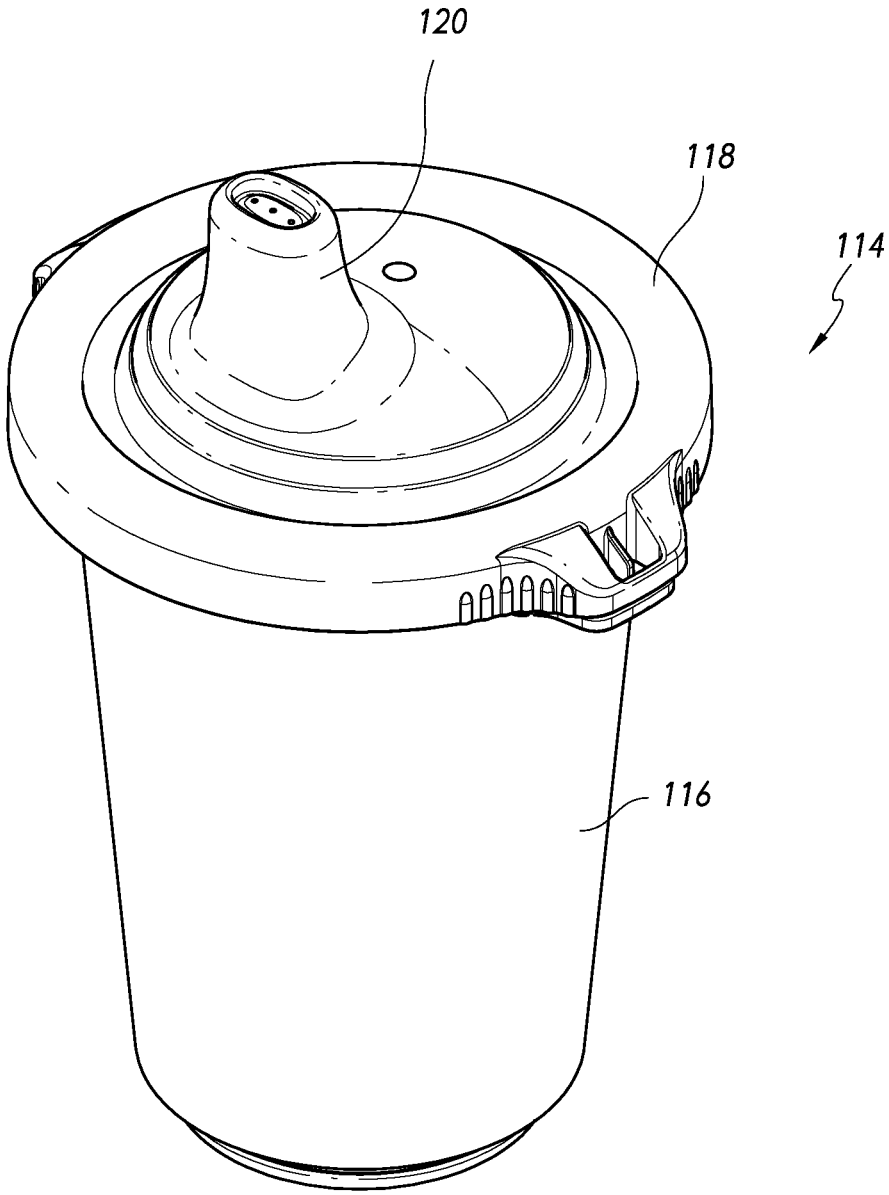
FIG. 15 is a perspective view showing a spillproof container assembly that is constructed according to a fifth embodiment of the invention.

FIG. 15 depicts a spillproof cup assembly 114 according to a fifth embodiment of the invention, having a cup body 116, a lid body 118, and an integral drinking spout 120.

Figure 16:
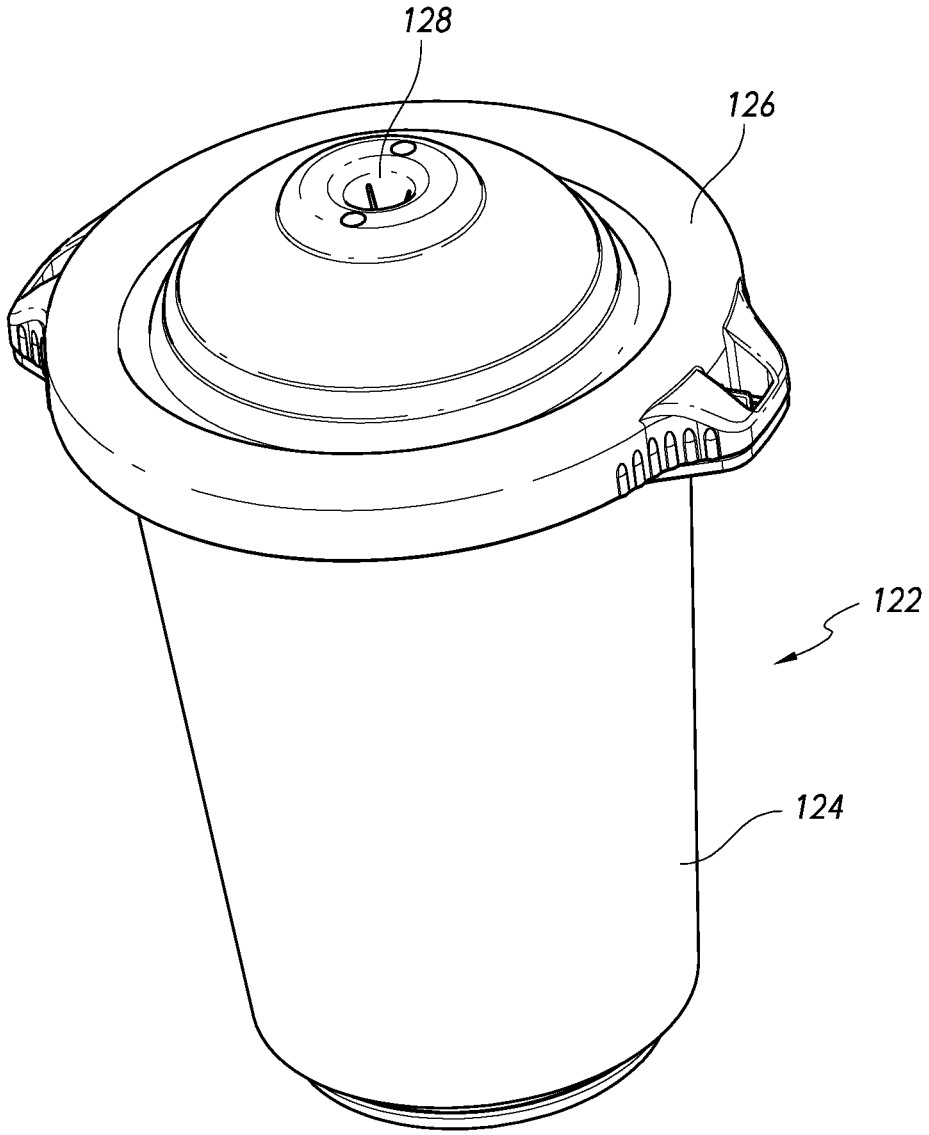
FIG. 16 is a perspective view showing a spillproof container assembly that is constructed according to a sixth embodiment of the invention.

FIG. 16 depicts a spillproof cup assembly 122 according to a sixth embodiment of the invention, having a cup body 124, and a lid body 126 having an opening on 128 defined therein for receiving a drinking straw.

Figure 17:
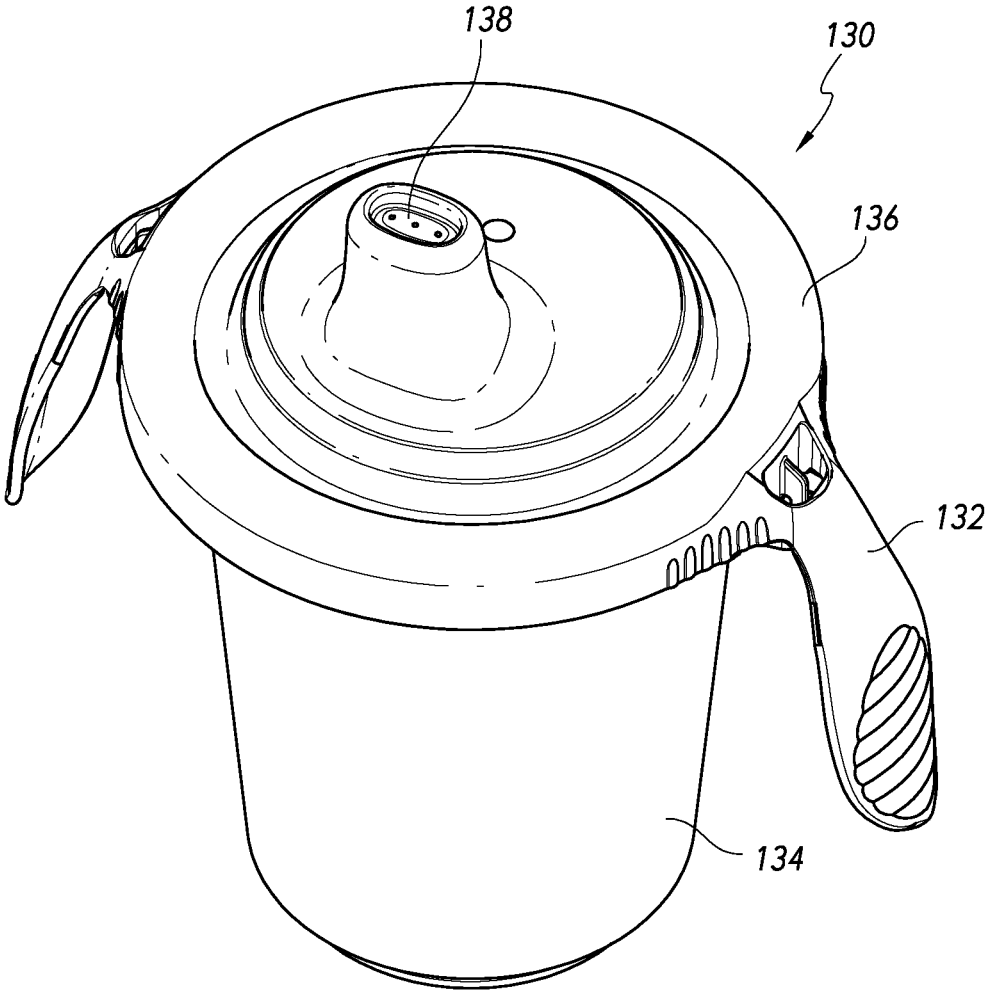
FIG. 17 is a perspective view showing a spillproof container assembly that is constructed according to a seventh embodiment of the invention.

FIG. 17 depicts a spillproof cup assembly 130 according to a seventh embodiment of the invention, having a cup body 134, a lid body 136 having integrated handles 132 and an integrated drinking spout 138.

Figure 18:
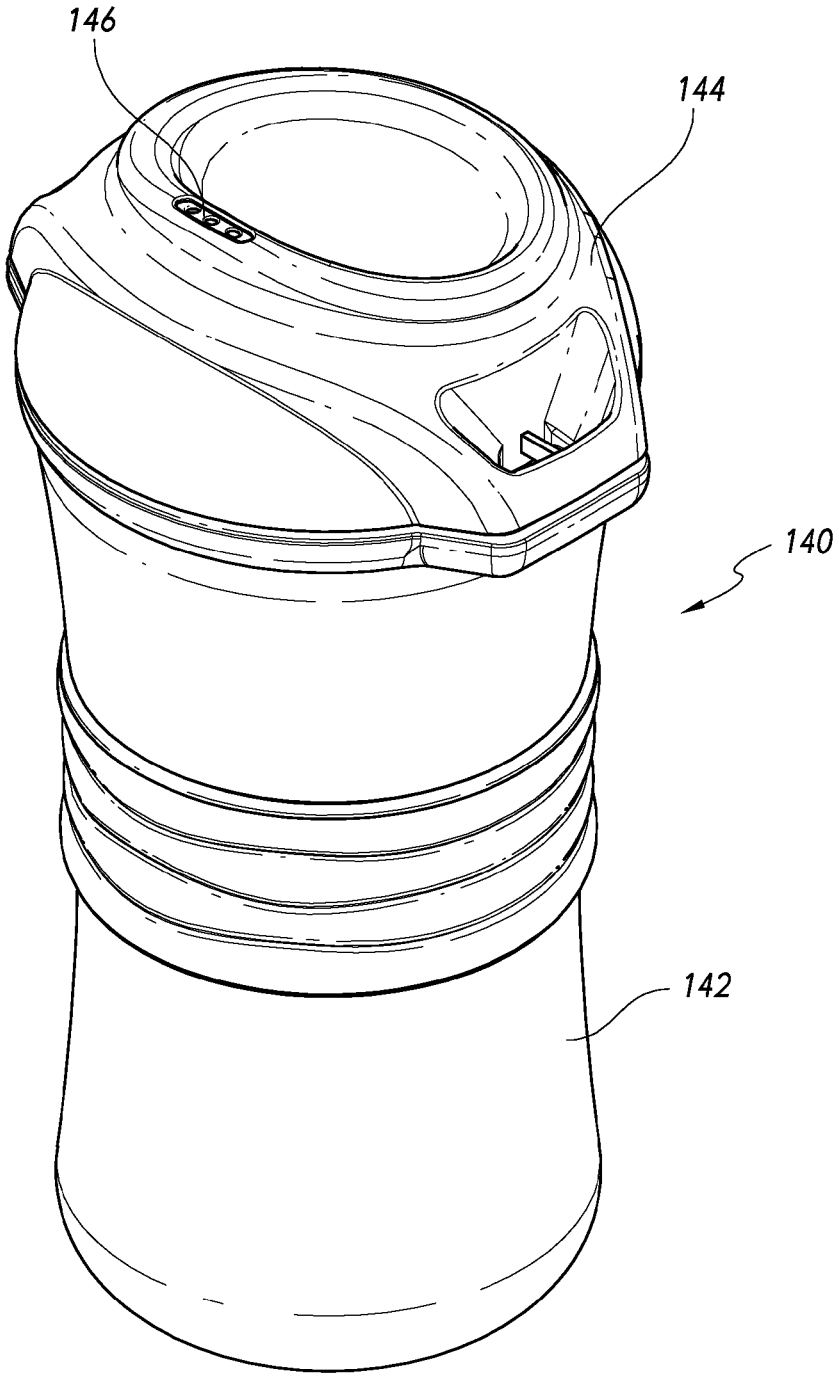
FIG. 18 is a perspective view showing a spillproof container assembly that is constructed according to an eighth embodiment of the invention.

FIG. 18 depicts a spillproof cup assembly 140 according to an eighth embodiment of the invention, having a cup body 142, and a lid body 144 having a plurality of drinking holes 146 defined therein.

Figure 19:
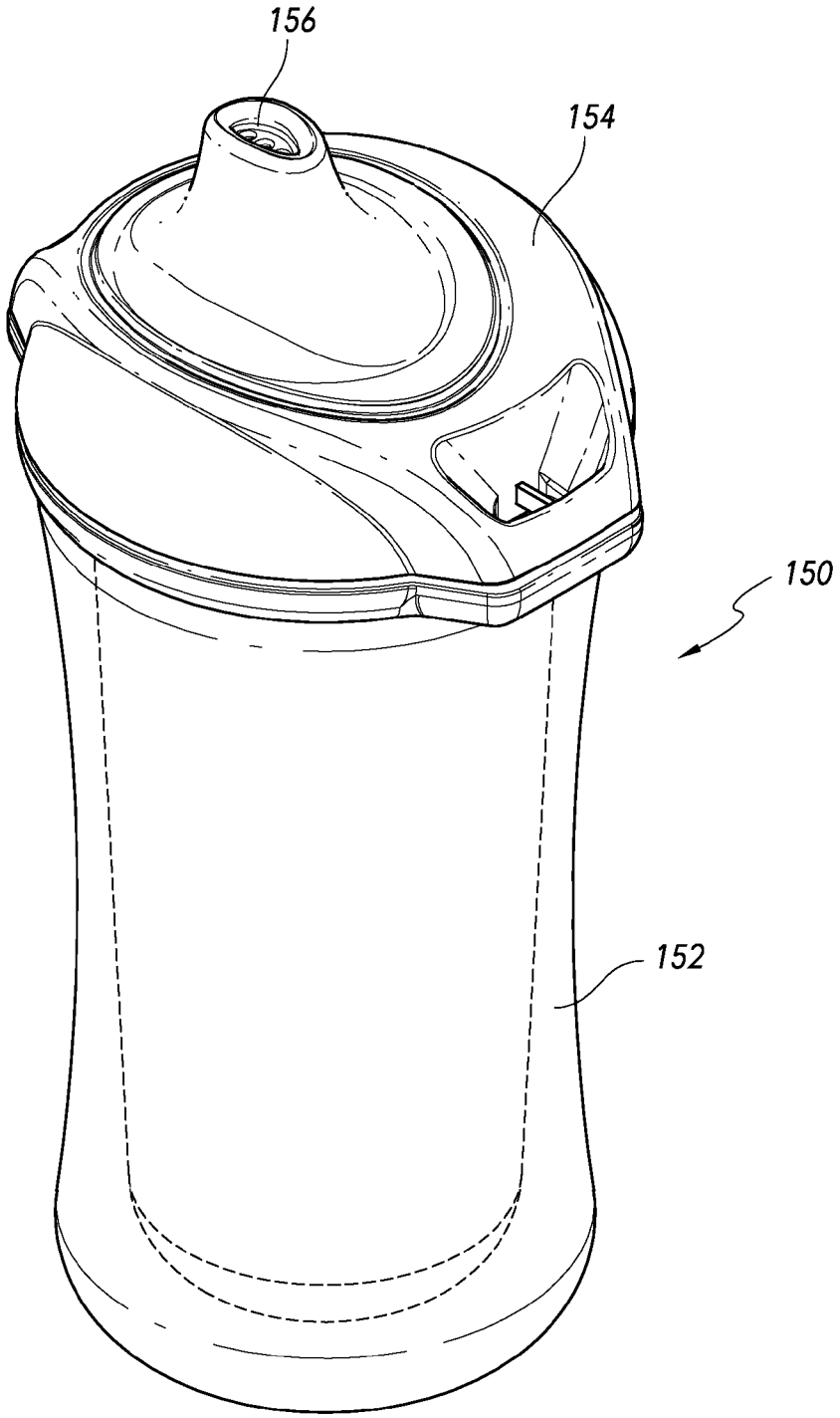
FIG. 19 is a perspective view showing a spillproof container assembly that is constructed according to a ninth embodiment of the invention.

FIG. 19 depicts a spillproof cup assembly 150 according to a ninth embodiment of the invention, having an insulated cup body 152, a lid body 154 and an integrated drinking spout 156.

Figure 20:
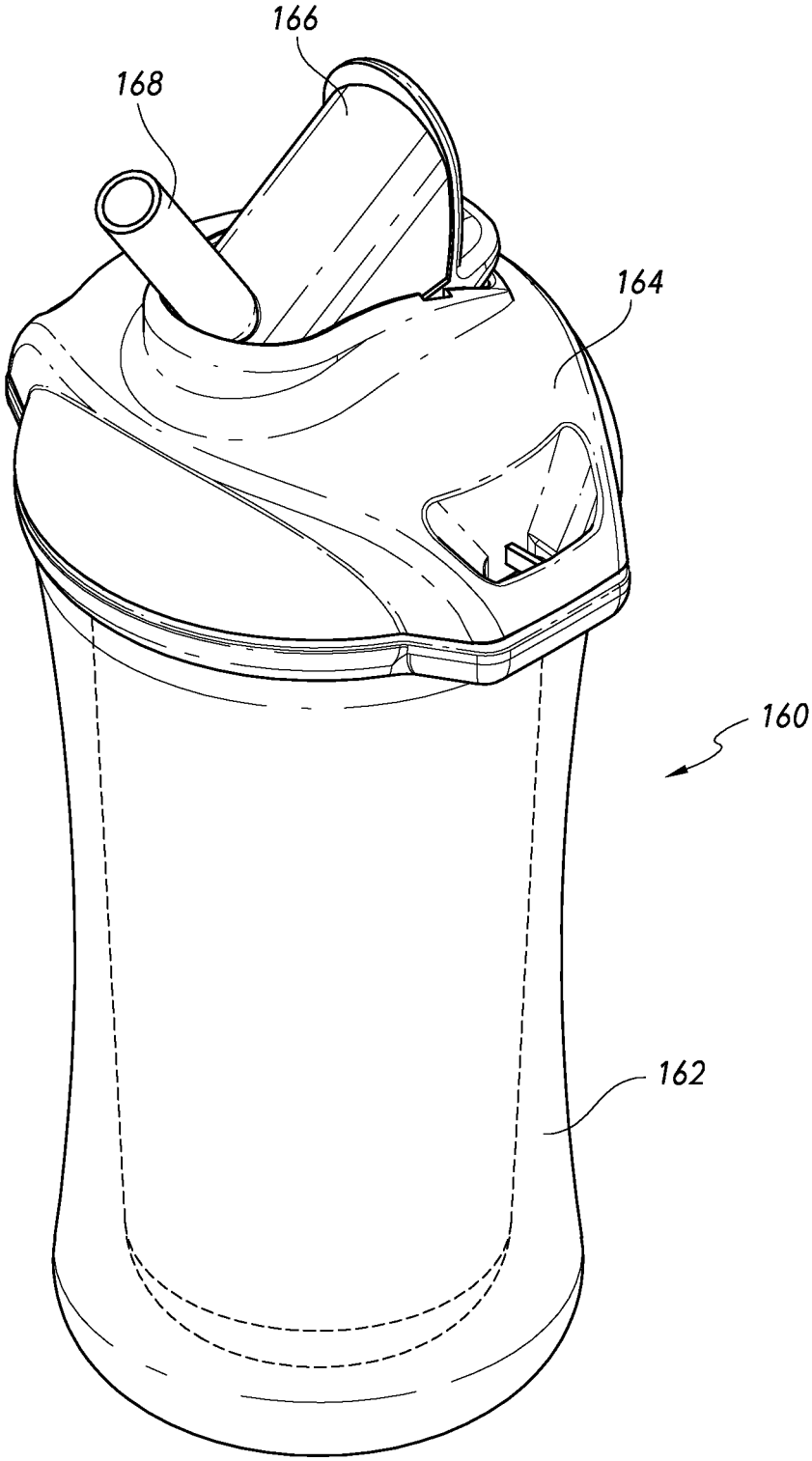
FIG. 20 is a perspective view showing a spillproof container assembly that is constructed according to a tenth embodiment of the invention.

FIG. 20 depicts a spillproof cup assembly 160 according to a tenth embodiment of the invention, having an insulated cup body 162, a lid body 164 and a straw deployment mechanism 166 for selectively deploying a drinking straw 168.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A container for a spillproof drinking assembly, comprising:

a container body having a first upper open end and a lower closed end;

a neck extending cylindrically outward and away from the first upper end of the container body, the neck including at least one threaded fastener on an outer surface of the neck to receive a cap, wherein an outer surface of an upper end of the container body extends below the neck radially outward to define a shoulder;

a platform is disposed on the shoulder; and a snap projection is disposed on the platform, wherein the snap projection extends upward, away from the platform to a predetermined height.

2. A container for a spillproof drinking assembly according to claim 1, wherein the platform is disposed on top of an upper surface of the shoulder.

3. A container for a spillproof drinking assembly according to claim 2, wherein the platform is substantially flat.

4. A container for a spillproof drinking assembly according to claim 1, wherein the snap projection extends radial from a first end adjacent to an outer end of the shoulder.

5. A container for a spillproof drinking assembly according to claim 4, wherein the snap projection extends radially inward to a second end adjacent to an inner end of the shoulder adjacent to the neck.

6. A container for a spillproof drinking assembly according to claim 5, wherein a gap is provided between the second end of the snap projection and the neck.

7. A container for a spillproof drinking assembly according to claim 1, wherein the snap projection comprises a snap ridge.

* * * * *